US005149900A

United States Patent [19]

Buck

[11] Patent Number: 5,149,900

[45] Date of Patent: Sep. 22, 1992

[54] FIREARM SUPPORT WITH SEAT

[75] Inventor: Bruce Buck, Glencoe, Minn.

[73] Assignee: Virgil J. Buck, Barrett, Minn.

[21] Appl. No.: 800,844

[22] Filed: Nov. 29, 1991

[51] Int. Cl.[5] ..... F41A 23/06

[52] U.S. Cl. ..... 42/94; 248/122

[58] Field of Search ..... 248/122, 145, 131, 150, 248/415; 297/411, 417, 416, 349; 42/94; 89/37.04

[56] References Cited

U.S. PATENT DOCUMENTS

| | | | |
|---|---|---|---|
| 2,616,692 | 11/1952 | Bird | 248/122 X |
| 3,125,929 | 3/1964 | Peasley . | |
| 3,667,773 | 6/1972 | Hess . | |
| 4,184,711 | 1/1980 | Wakimoto | 297/379 X |
| 4,318,567 | 3/1982 | Guthier | 297/184 |
| 4,409,751 | 10/1983 | Goda et al. | 42/94 |
| 4,506,466 | 3/1985 | Hall | 42/94 |
| 4,535,559 | 8/1985 | Hall | 42/94 |
| 4,558,531 | 12/1985 | Kilby | 42/94 |
| 4,580,483 | 4/1986 | Garbini | 42/94 X |
| 4,886,229 | 12/1989 | Aripze-Gilmore | 248/125 |
| 4,934,638 | 6/1990 | Davis | 248/164 |
| 4,937,965 | 7/1990 | Narvaez | 42/94 |
| 4,967,497 | 11/1990 | Yakscoe | 42/94 |
| 5,060,410 | 10/1991 | Mueller | 42/94 |

*Primary Examiner*—Ramon O. Ramirez
*Attorney, Agent, or Firm*—Haugen and Nikolai

[57] ABSTRACT

A firearm support and seat arrangement is revealed, comprising a tripod supported seat assembly, an articulating support arm assembly which includes individual arm segments pivotally connected to one another, and a cradle means for supporting the firearm. The support is also well suited to support a variety of other motion sensitive devices including cameras, sensors, transmitters and other recording equipment.

8 Claims, 9 Drawing Sheets

22
21
20
17
16
14
15
12
10
27
11
26
25

91
91A
91B
92
90
51
94
93
28
97
96
30
97A
95A
96A
95
106
95B
23
97B
96B
26
102
105
27
25
96C
99
100B
98
101
100A
104
100

17
123
39
121
122
124
120
75
77
125
76
73
17

FIREARM SUPPORT WITH SEAT

FIELD OF THE INVENTION

The present invention is generally directed to stabilizing supports, and more specifically directed toward gun supports to be utilized by those engaged in either hunting for sport or target shooting.

BACKGROUND OF THE INVENTION

Generally, a person either in a standing, crouching or prone position can aim a firearm approximately 180 degrees horizontally and 180 degrees vertically, and can further aim at all points in between. Without the aid of a stabilizing device such as, for example, a conventional firearm support, the user of a firearm may shoot within the above described parameters. However, it is known that one holding a firearm in an unsupported fashion is less able to establish and maintain an accurate aim than is one who is utilizing a stabilizing device such as, for example, a conventional firearm support. A conventional firearm support, however, greatly restricts the spherical range of one's shooting, and increases the time requirement of taking aim, particularly at a moving target.

When either target shooting with a pistol or rifle, or rifle hunting, it is customary for the person shooting to rest his or her arms and/or hands on a solitary support surface so as to insure that the firearm will be steady when fired. Many methods have been employed by marksmen/hunters over the years to achieve the desired steady non-wavering barrel. For example, one might use the ground, a boulder, or a tree limb upon which to rest his or her arms. An inherent disadvantage entailed in connection with this use is, however, evident: the shooter is at the mercy of nature's placement of the ground, boulder, or tree limb. This beinq the case, the desired target may not be accessible to the shooter while using the support, and he or she is left to unsteadily fire from, for example, either a standing or crouching position.

Another way to insure a steady shot is to employ a firearm support. Such items are well known in the art. Generally, firearm supports consist of a seat in combination with a table-like surface upon which the shooter rests his or her arms. The inherent disadvantage of such firearm supports is that the user remains limited or restricted in the number of adjustments he or she can make in connection with his or her aim. For example, a flat bench-type firearm support is of little assistance if the target is significantly uphill or downhill from the shooter. A further disadvantage of a conventional firearm support is that as a general rule, such devices are not designed to be transported into the field, and tend to be bulky and/or heavy, therefore effectively limiting their application to one particular prearranged area such as, for example, a shooting range.

There is, therefore, a need for a device which will aid hunters and target shooters in maintaining stability while firing, which will allow the range of shots available to such a shooter or hunter to remain as unrestricted as is possible, and which is light-weight and may be easily transported.

It is an object of the present invention to provide a firearm support which will allow the user to realize the stabilizing benefits of a firearm support while simultaneously realizing the benefits of the availability of a large spherical shooting range.

It is a further object of the present invention to provide an improved firearm support which is easily transported to and from the field.

It is a further object of the present invention to provide an improved firearm support which is both collapsible and easily assembled in the field.

It is a further object of the present invention to provide a light weight, easy to carry firearm support.

It is a further object of the present invention to provide a general purpose support for stabilizing a variety of motion sensitive devices including cameras, sensors, transmitters and recording equipment.

Other and further objects with become apparent from a study of the following specification, accompanying drawings and appended claims.

SUMMARY OF THE INVENTION

A collapsible firearm support is revealed comprised of a single articulating support assembly comprising a plurality of generally rigid arms or shafts, each of which is pivotally secured to its neighboring arm or shaft and which may be pivotally adjusted horizontally and/or vertically. The cradle member comprises a distally arranged generally flexible cradle upon which the gun is rested, with the cradle including a pad designed to allow the user of the firearm support to securely squeeze said pad around the stock portion of the weapon, either a rifle, shot gun, or barrel portion of a pistol, thereby securing the gun within the cradle in a customized fashion. The base or proximal end of the cradle member is secured to a hub member located beneath a seat or bench member. The firearm support of the instant invention is lightweight and collapsible, and may contain a strap for convenient carrying to and from the field.

The present invention can also be adapted to support and stabilize a variety of other apparatuses such as cameras, sensors, and other motion sensitive devices.

IN THE DRAWINGS

Figure 8:
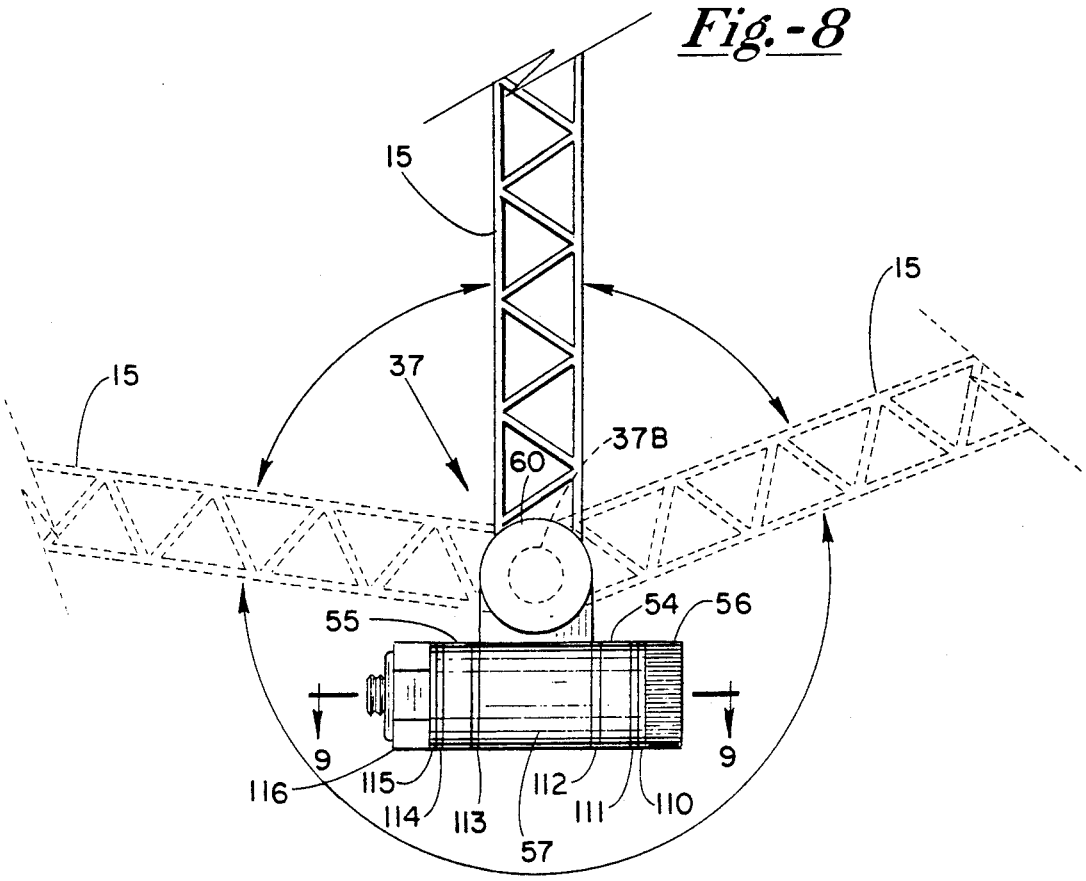
FIG. 8 is a front elevational view, partially broken away, illustrating, on a slightly enlarged scale, one of the pivot link members utilized in the articulating support arm assembly, and with the figure illustrating, in phantom, various positions of movement possible with individual members of the articulating support arm assembly.
Figure 9:
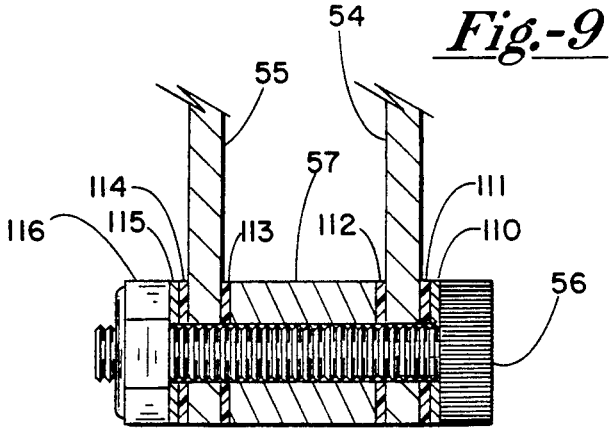
Figure 10:
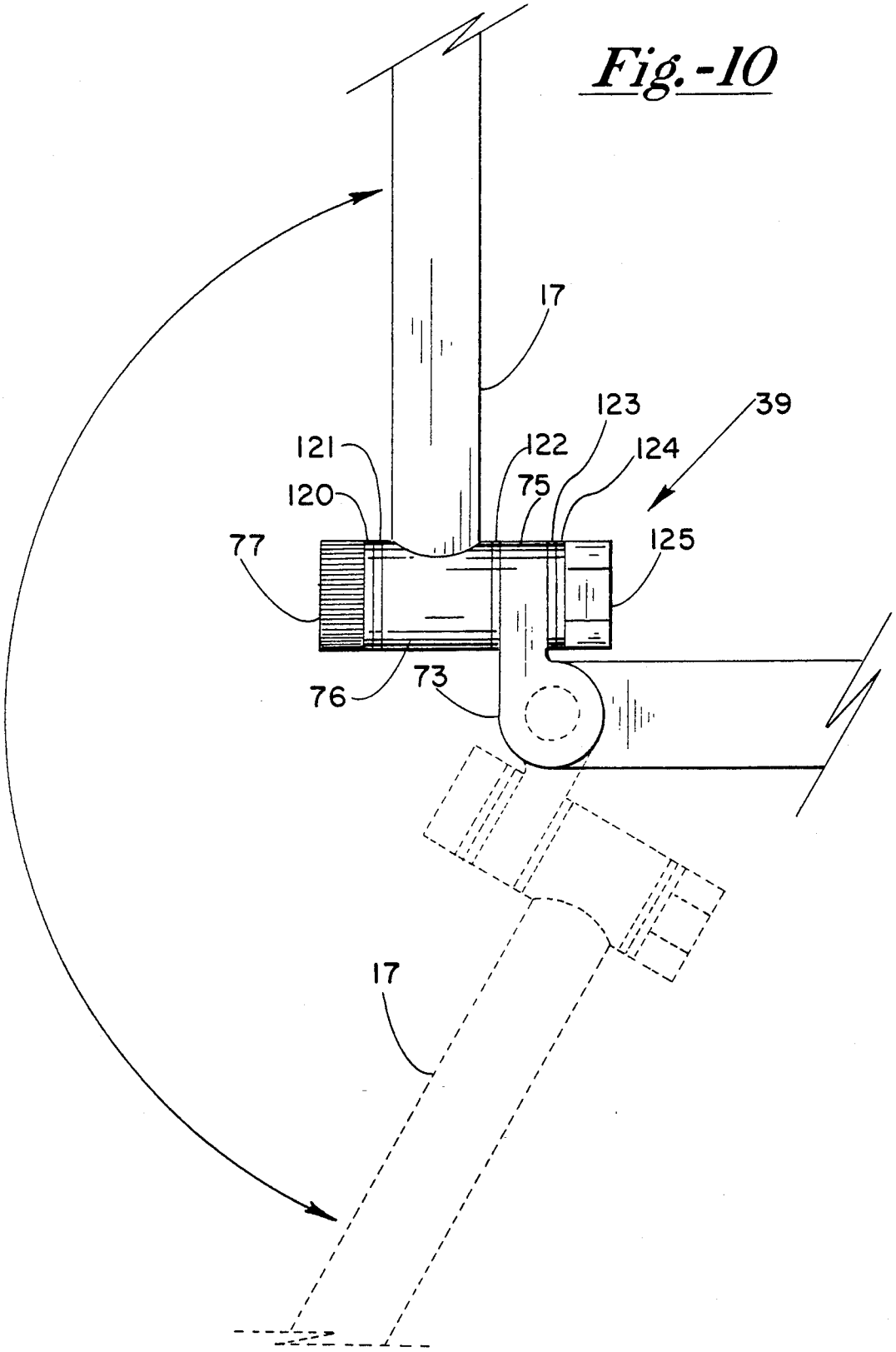

FIG. 9 is a detail sectional view, taken along the line and in the direction of the arrows 9—9 of FIG. 8; and FIG. 10 is a side elevational view, partially broken away, illustrating, on a slightly enlarged scale, one of the pivot link members utilized in the articulating support arm assembly, and with the figure illustrating, in phantom, various positions of movement possible with individual members of the articulating support arm assembly.

DESCRIPTION OF THE PREFERRED EMBODIMENT

Figure 1:
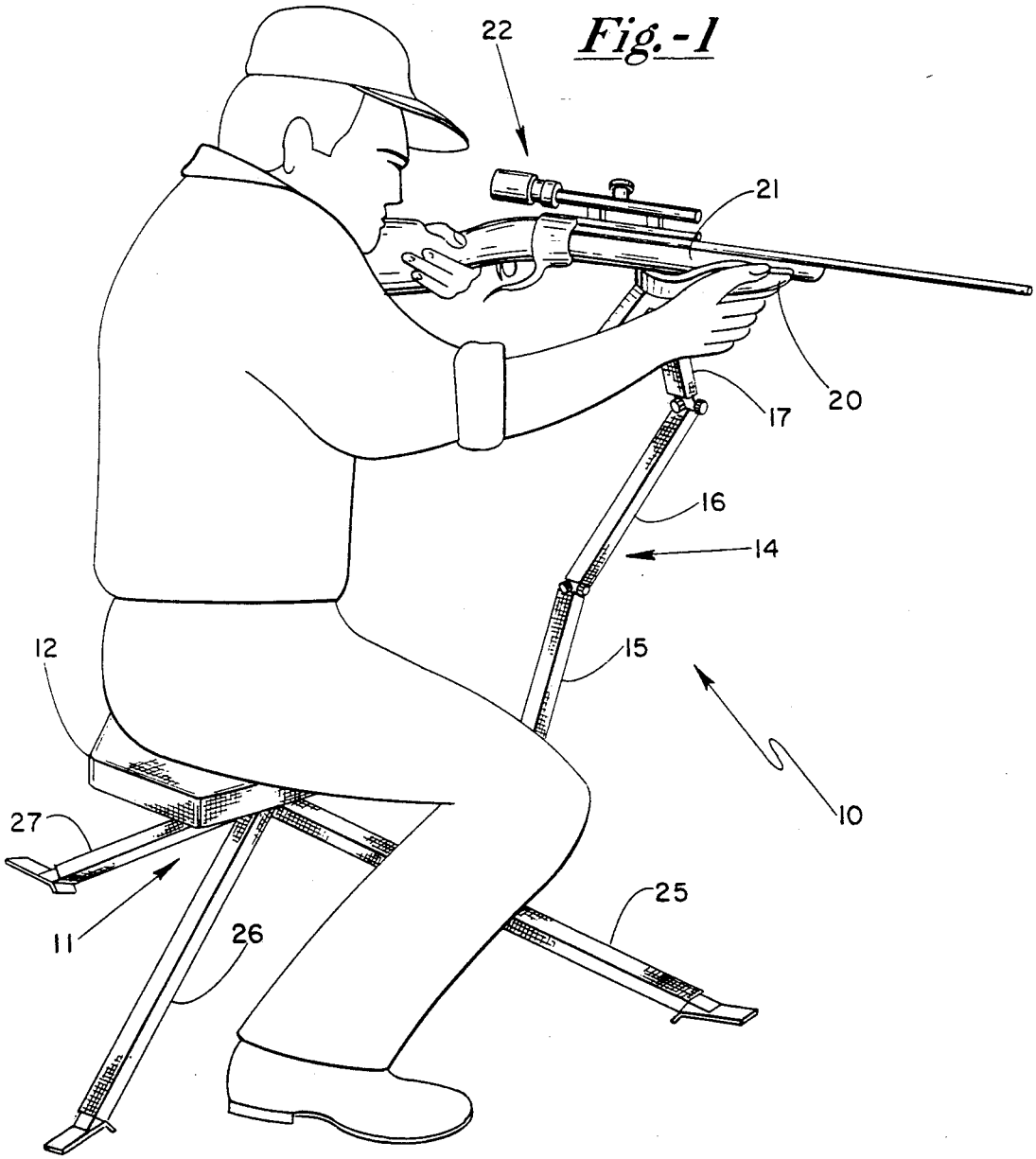
FIG.1 is a perspective view of the device and illustrates an individual marksman actively employing the firearm support of the present invention and with a firearm in hand.

Turning to FIG. 1, the firearm support with seat of the present invention, generally designated 10, includes a tripod supported seat assembly, comprised of a tripod base support means generally designated 11 designed to support a seat 12 therealong. The support frame 11 further includes a means for attaching and supporting articulating support arm assembly generally designated 14 in suitably arranged disposition thereupon. Articulating support arm assembly 14 includes a plurality of individual arm segments 15, 16, and 17, along with a laterally extending arm 18 arranged at the base of articulating support arm assembly 14 (see FIG. 2). The entire device 10 may be optionally camouflaged in a known way, as shown in FIG. 1. As can be seen in FIG. 1, arm segment 17 is provided with a generally "U"-shaped cradle as at 20 for supporting the stock component 21 of rifle 22 being sighted by the marksman illustrated in FIG. 1. As is apparent in FIG. 1, the marksman is seated upon the rotatable seat 12 of device 10, with the articulating support arm assembly 14 being utilized to accurately position and movably support rifle 22 thereon.

For achieving stable and solid support on the earth, a tripod support means is provided at the base of the device 10, with this assembly being shown generally at 11. The tripod support includes the three equally angularly disposed legs 25, 26 and 27, each of which is pivotally secured to support hub member 28. (See FIG. 7.) As is apparent, legs 25, 26 and 27 are each pivotally secured to hub member 28, with two of the legs, 25 and 26, being pivotally secured about a generally vertically disposed axis, and with the remaining leg, leg 27 being supported on a generally horizontally disposed axis. As is apparent in the view of FIG. 5, leg 27 is adjustably locked in an arcuately limited position by means of knurled bolt 30 which is threadably engaged into bracket portion 31 of hub 28. As is further apparent in a review of FIG. 5, a bore as at 33 is provided to receive a carrying strap therewithin, with bore 33 being formed in ear member 34 and secured, thereby, to the overall firearm support 10.

Figure 5:
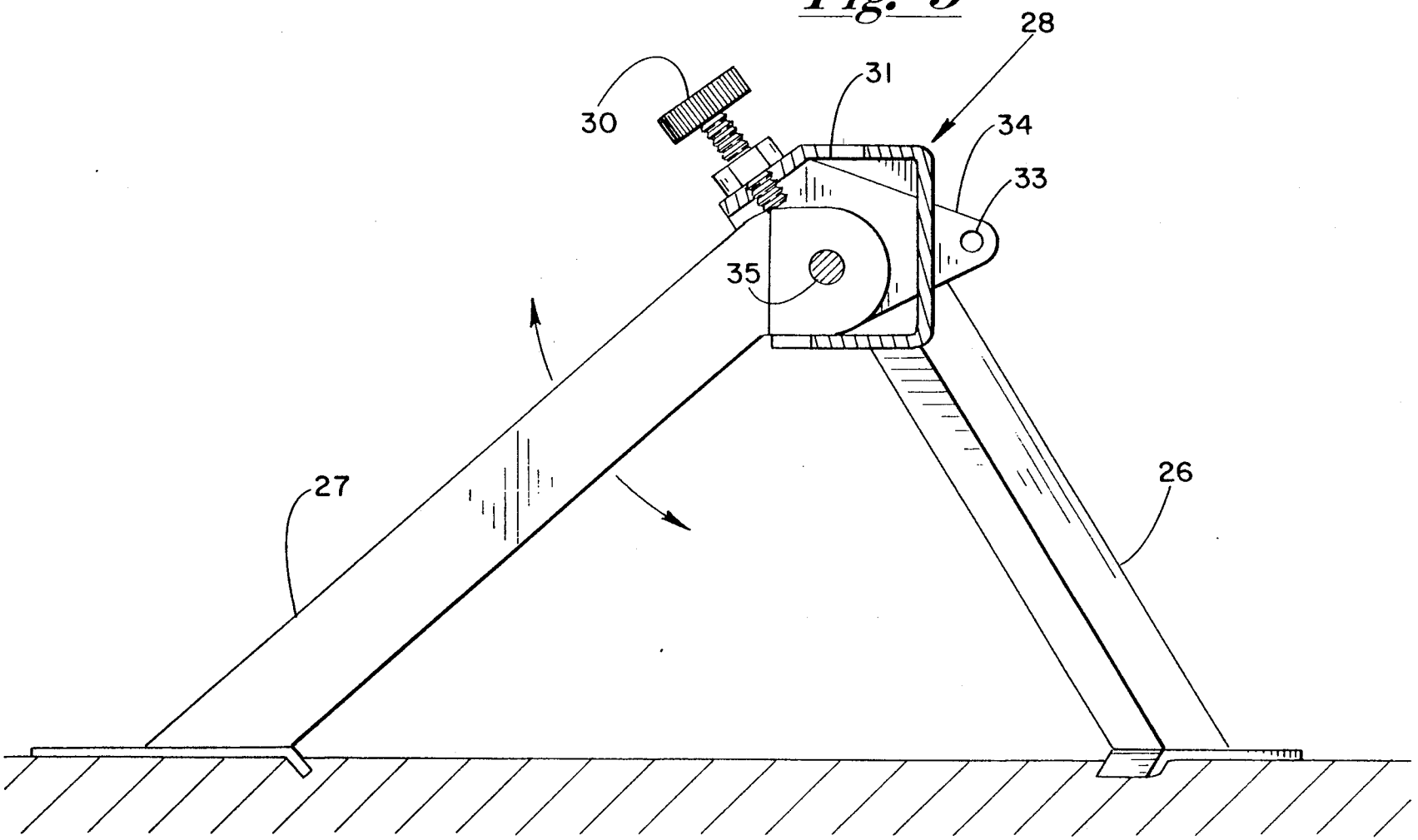
FIG. 5 is a side elevational view, partially in section, and illustrating the adjustment feature for stability of the device, with the rear leg having been removed for the purpose of clarity.

With further attention being focused on FIG. 5, in order to achieve stable and level support for the device, and as previously indicated, legs 25 and 26 are arranged to pivot on vertically disposed axes, with leg 27 being arranged to pivot on a horizontal axis. Since knurled bolt 30 is designed to contact leg 27 in its arcuate movement about pivot pin 35, the extent of arcuate movement of leg 27 is readily and easily controlled. This is designed in order to permit use of the device in, on, and along uneven terrain, particularly of the type frequently encountered by hunters in pursuit of game.

Figure 2:
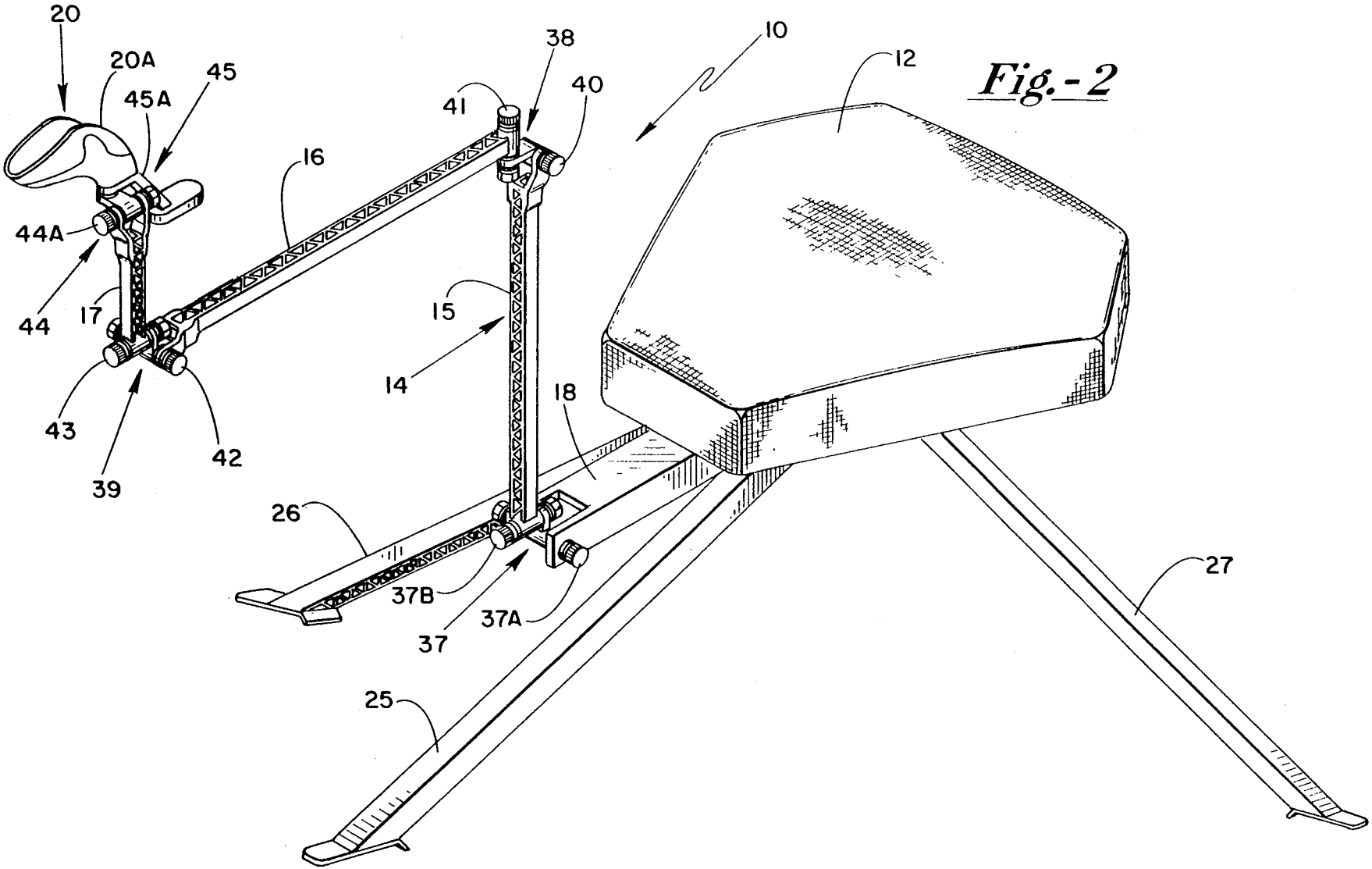
FIG. 2 is a perspective view taken along the front and side portions of the device and illustrating the mechanism in partially erected form.

Attention is now directed to FIG. 2 of the drawings wherein the articulating support arm assembly 14 is illustrated. Specifically, the articulating support arm assembly 14 comprises a plurality of individual arm segments 15–18 inclusive. Segments 15–17 inclusive are arranged to be pivotally coupled, one to another, with the proximal end of arm segment 18 being rigidly secured to the undersurface of seat 12, such as on seat support base board 36 (See FIG. 3). A U-bolt 18A or other suitable fastener or fasteners is used for this purpose. With attention being drawn to FIG. 3, it is seen that U-bolt 18A is, as noted, secured beneath seat 12, and, as noted, secures arm segment 18. U-bolt 18A is threaded, and two nuts 18B and 18C force rigid member, such as clamping strap 18D, against arm segment 18 for a secure fit. Clamping strap 18D may consist of a metallic or other sturdy band or plate. It is to be understood that arm segment 18 may be rigidly secured to undersurface of seat 12 through the use of any number of other fastening devices and/or methods.

With continued attention being drawn to FIG. 2, it is seen that arm segment 18 is designed to be sufficiently long so as to permit the marksman to effectively straddle this member while employing the firearm support device 10. While so straddling member 18, arm segments 15–17 are effectively employed to support and otherwise cradle firearm 22 thereon. Each link between adjoining arm segments is provided with a pivot link member rotatable about two axes disposed at right angles, one to another. Specifically, pivot assemblies are provided as shown generally at 37, 38 and 39. It will be noted that pivot assembly 37 is comprised of an assembly pivotal about two axes 37A and 37B, the axes being at right angles, one to another. Member 38 also comprises a pivot assembly movable about two axes, 40 and 41, disposed at right angles, one to another. Furthermore, as is illustrated at 39, a second pivot assembly is shown with two pivot axes, 42 and 43, arranged at right angles, one to another. The firearm support device 10 also employs a vertically disposed axis as at 44.

During normal operation of the firearm support device 10, the marksman will, as previously indicated, position himself on the seat 12 with his legs straddling horizontally disposed arm segment 18. Upon gripping the distal end portion including pad portion 20A of cradle 20, the entire assembly may be pivotally moved either horizontally or vertically to accommodate the anticipated needs of the marksman. By actuation of the articulating support arm assembly 14 either horizontally and/or vertically, particularly about pivot assemblies 37, 38, 39 and 44, the marksman may obtain the appropriate and desired angle of rest for cradle 20 in which the firearm is resting. In order to achieve movement of the assembly, pivotal movement about axes 37A, 37B, 40, 41, 42, 43, 44 and 87 may be undertaken. With attention being directed to pivot assembly 37, the axes illustrated at 37A and 37B will provide degrees of freedom of motion, with axis 37B being utilized to achieve additional positioning control of articulating support arm assembly 14 to a desired position.

Pad portion 20A of cradle 20 is comprised of a flexible, sturdy material such as moderately pliable molded rubber. It has been found that firmly gripping the pad portion 20A of the cradle 20 allows the firearm support 10 to absorb a certain amount of post-shot recoil otherwise absorbed by, for example, the shoulder of a rifle shooter.

The instant device is also suitable for pistol shooting through the use of adaptor 45. In practice, the butt portion of the pistol will rest on adaptor surface 45A while the barrel is aimed through and on top of pad portion 20A of cradle 20. The adaptor 45 is easily removed if desired.

Each of the pivot assemblies, including assemblies, 37, 38, 39 and 44 are provided with a firm yet movable arrangement. Bolts or pins, hollow sleeves fabricated from a material such as molded nylon, and nylon washers may be employed to achieve this result. Thermoplastic or thermoset materials may be employed in addition to or in lieu of nylon. The details of these components in the assembly are shown in the view of FIG. 6.

Figure 3:
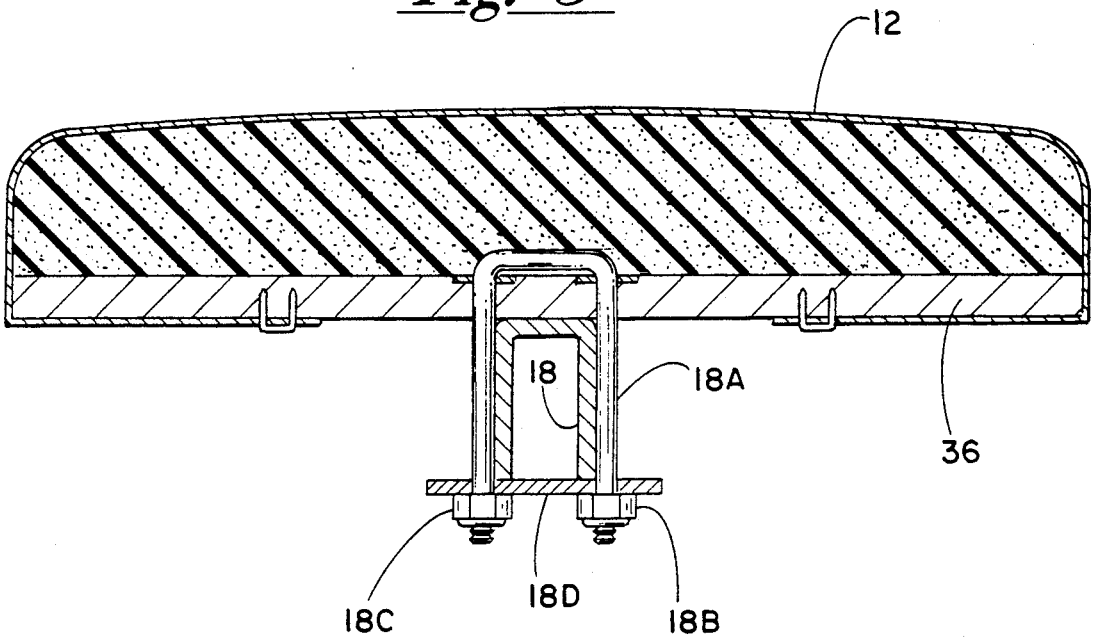
FIG. 3 is a horizontal sectional view taken along the line and in the direction of the arrows 3—3 of FIG. 6, with this view being taken through the seat member and illustrating the means for attaching the seat plate to the support frame.
Figure 6:
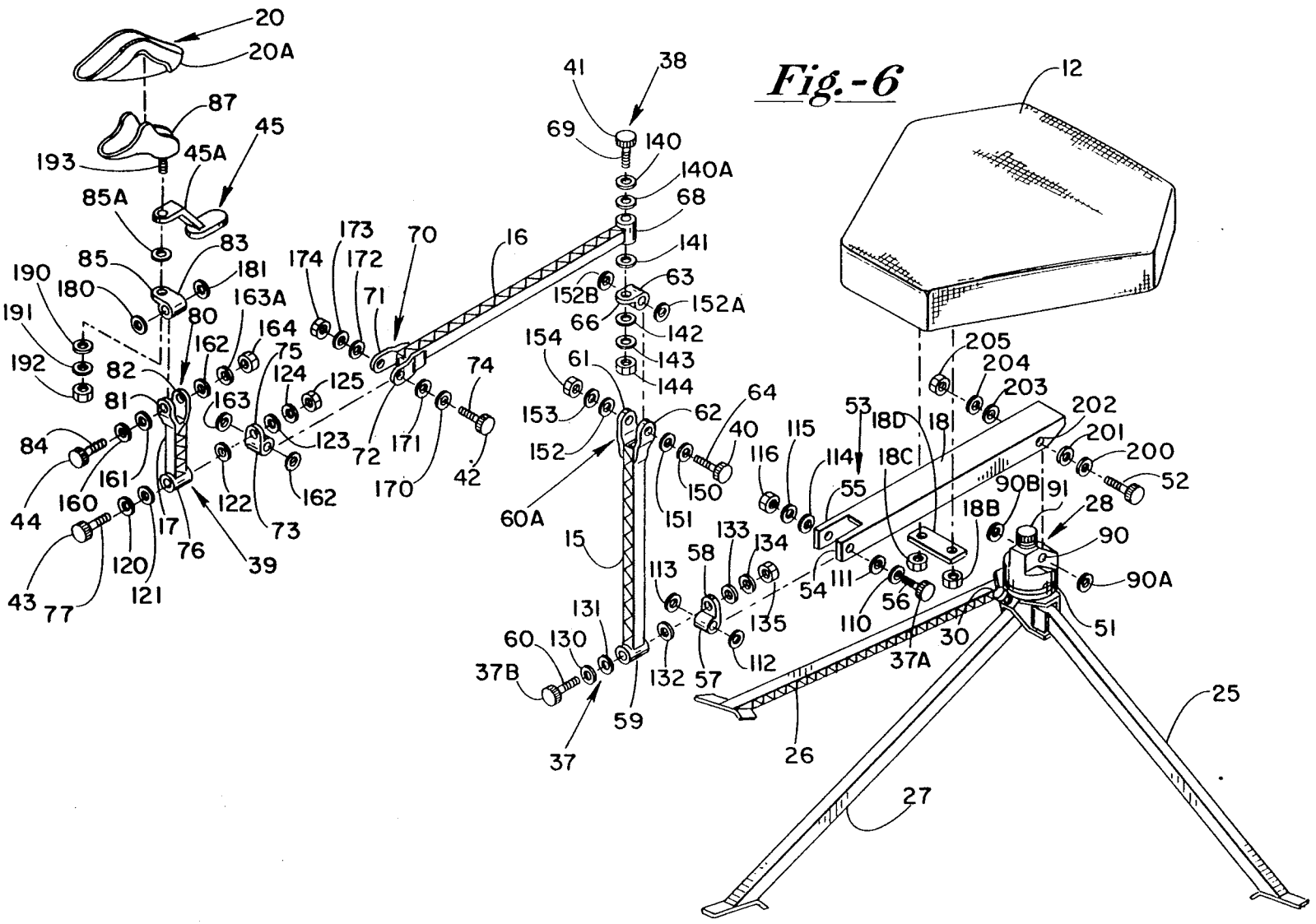
FIG. 6 is perspective view, in partially exploded form, illustrating the apparatus and its various components in exploded disposition.

Turning now to the detail of the assembly illustrated in FIG. 6, the arm segment 18 is utilized as a support for seat 12. Seat 12 is affixed to arm segment 18 through the use of U-bolts 18A, clamping straps 18D, and nuts 18B and 18C, as shown in FIG. 3. Seat 12 may also be affixed to arm segment 18 through the use of, for example, U-bolts and nuts if holes are bored through arm segment 18, or by any other conventional affixation methods. Arm segment 18 is, in turn, coupled to support hub member 28 via any convenient fastening means, such as through-bolt 52. The distal portion of arm setment 18 consists of a bifurcated tip member as at 53, which includes a pair of parallelly disposed ears 54 and 55. Bolt 56 is utilized to extend and otherwise pass through cylinder or sleeve 57, and thereby retain and permit pivotal motion of cylinder or sleeve 57 about a vertical axis through bolt 56. The upper surface of cylinder or sleeve 57 is provided with ear portion 58 extending radially outwardly from cylinder or sleeve 57, with ear 58 being coupled to cylinder or sleeve 59 of arm segment 15 by means of bolt 60. In this fashion, bolt 60 provides an axis along a plane about which arm segment 15 may pivot arcuately whenever such motion is required. At the distal portion of arm 15, a bifurcated tip member is provided at 60A which includes a pair of ears 61 and 62, with ears 61 and 62 being arranged to receive therebetween cylinder or sleeve 63. Bolt 64 is arranged to pass through the bores formed in ears 61 and 62, and also pass through the through-bore arranged in cylinder or sleeve 63. A single ear is arranged generally radially outwardly of cylinder or sleeve 63, as at 66. Ear 66 is designed to mate with proximal cylinder or sleeve 68 disposed on arm segment 16. Bolt 69 is designed to pass through cylinder or sleeve 68 and ear 66, thereby providing an axis of free movement about an axis 41 defined by bolt 69. The bifurcated tip member of arm segment 16, as at 70, comprises a pair of ears 71 and 72 which are designed to receive and otherwise contain cylinder or sleeve member 73 therewithin. Member 73 is mounted upon the assembly through use of bolt 74, with ear 75 being designed to be coupled to and otherwise receive proximal cylinder or sleeve 76 of arm segment 17. Bolt 77 is provided as an axis of rotation for arm segment 17 about the axis 43 established by the bore formed in ear 75. A bifurcated tip member is provided at distal end of arm segment 17, as at 80 with ears 81 and 82 being provided to receive cylinder or sleeve member 83 therewithin. Bolt 84 is utilized to capture and otherwise retain member 83 within the bifurcated tip member 80.

A bore is formed in ear 85 and is designed to receive coupling bolt 193 therewithin which will secure sub-cradle portion 87 of cradle 20 to arm 17. Adapter 45 is optionally attached to cradle 20. Coupling bolt 193 is inserted through sub-cradle 87, wherein it enters a bore formed in optional adapter 45, a washer 85A, ear 85 and washers 190 and 191. Coupling bolt 193 is then secured via nut 192. Pad 20A attaches to sub-cradle 87 via an attaching means such as, for example, a conventional snap mechanism located on the bottom of pad 20A. By so attaching, the used surface of pad 20A remains smooth and level.

In actual use, therefore, the present invention provides the marksperson within a total of at least seven axes of movement, a virtually unlimited or infinite number of target areas within the zone of approximately one hemisphere.

Since these axes contain materials formed of nylon, thermoplastic or thermoset materials, and have smooth mating surfaces, the motion is smooth, unrestricted, and yet provides a firm base support for the firearm 22. As a further feature of the invention, the individual pivot members with the possible exception of the pivot axis for seat 12, employ in part material such as molded nylon which has a relatively high coefficient of friction when in the static position, but with a significantly lower coefficient of sliding friction. Thus, in practice the shooter is allowed to quickly and accurately move arm segments 15, 16 and 17 to a position where the firearm is accurately aimed. Once aimed, the user is allowed to keep the firearm in a stable and static position, or, alternatively, follow a moving target in a steady fashion. Adjustment of the resistance of pivotal motion may be achieved by adjustment of knurled knobs provided for each of the individual axes, including axes 37A, 37B, 40, 41, 42, 43, 44 and 87.

In addition to the use of molded nylon components, other thermoplastic and thermoset materials may also be employed. Examples of such additional materials include polymers such as polyethylene, polypropylene, polycarbonates, and epoxy-base materials. Others may be found useful as well. Use of any of these materials has the further benefit of being relatively quiet when, for example, the device 10 is being adjustably aimed at game. This is due to the absence of metal-on-metal friction which, it is known, can be noisy.

In order to achieve appropriate pivotal motion of seat 12 and its attached components about a vertical axis, seat 12 is secured to arm segment 18 through attachment fasteners such as clamping straps, and by bolt 52 passing through the bore 90 formed in member 51. Bolt 52 passes through washers 200 and 201, bore 202, washers 202A and 202B (not shown), bore 90, and washers 203 and 204, and is secured by nut 205. Washers 200 and 204 are preferably comprised of steel or aluminum, while washers 201 and 203 are preferably comprised of nylon, thermoplastic, or thermoset materials.

Figure 7:
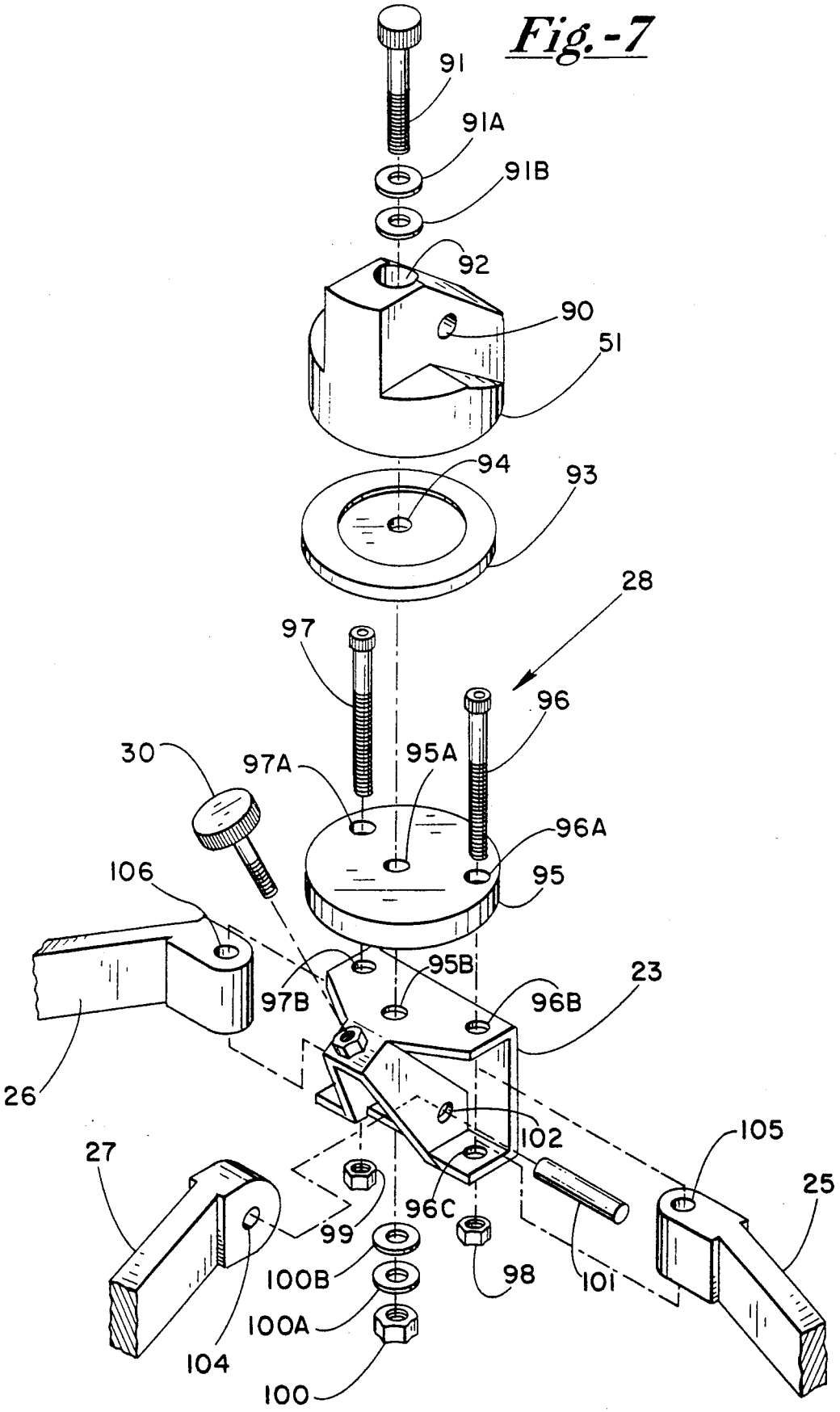
FIG. 7 is a detail view, on a slightly enlarged scale, and illustrating, in exploded disposition, the hub assembly, including that portion of the apparatus utilized in pivotally attaching the support legs to the hub assembly.

Turning to FIG. 7, member 51 is, as shown, made part of hub 28 by means of through-bolt 91. Bolt 91 passes through washers 91A and 91B, and bore 92, and through disc 93 via bore 94. Disc 93 may be comprised of nylon, thermoplastic, or thermoset materials. A second plate as at 95 is provided, and includes bore 95A, with plate 95 being utilized as a mating surface for disc 93, with plate 95 being secured to tripod support means 23 by means of a pair of cap screws as at 96 and 97. Cap screws 96 and 97 pass through bores 96A, 96B, 96C, 97A, 97B and 97C (not shown) and are then secured by nuts 98 and 99. Nut 100 is utilized to secure through-bolt 91 in place, bolt 91 having been passed through tripod support means 23, via washers 91A and 91B, bore 92, bore 94, bore 95A, bore 95B, and through washers 100B and 100A.

With attention now being continued to be directed to FIG. 7, support pin 101 is provided for attachment to tripod support means 23 through a pair of bores with one of these bores being depicted at 102, and ultimately passing through bore 104 formed in leg 27. Cap screws 96 and 97 provide vertically disposed axes for receipt of legs 25 and 26, particularly through the vertically disposed bores 105 and 106 formed therewithin. The entire seat 12 is rotatable on a 360 degree axis, while the legs 25, 26 and 27 remain stable. Articulating support arm assembly 14 rotates with seat 12.

When not in use, the weight of arm segments 15, 16, 17 and 18 and their component parts, cause arm segment 18 to pivot forward, resulting in a more compact configuration when carrying the device 10. The weight of a user on seat 12 pivots arm segments 15, 16, 17 and 18 upwards for ease of use.

With attention now being drawn to FIG. 8, it is seen that the arm segments 15, 16, and 17 employed in connection with the instant device are freely rotatable through use of pivot assemblies 37, 38, and 39 and 44. FIG. 8 depicts arm segment 15 rotating on an axis 37B generally defined by bolt 60.

With attention being drawn to FIG. 9, it will be seen that the particular elements contained in all of the pivot assemblies utilized in the apparatus include bolt or pin as at 56, washer as at 110, washer as at 111, washer as at 112, cylinder or sleeve as at 57, washer as at 113, washer as at 114, washer as at 115, and nut as at 116. With further attention being drawn to FIG. 9, it has been found that washers 110 and 115 are ideally comprised of steel or aluminum, while washers 111, 112, 113, and 114 are ideally comprised of a material such as nylon or thermoplastic or thermoset materials which have a relatively high coefficient of friction when in the static position, but have a significantly lower coefficient of sliding friction. No metal-to-metal friction occurs. Adjustment of the resistance of pivotal motion is, as noted earlier, achieved by adjustment of knurled knobs contained on the ends of bolts 56, 60, 64, 69, 74, 77, 84 and 193. Cylinder or sleeve 57 may be comprised of molded nylon, thermoplastic, thermoset materials, or any durable material. While pivot assembly 37 has been chosen for discussion, it will be understood that identical components are employed in connection with pivot assemblies 38, 39 and 44. In connection with this, attention is drawn back to FIG. 6 where the following correspond to washer 110: washer 150, and washer 170; where the following correspond to washer 111: washer 151 and washer 171; where the following correspond to washer 112: washer 152A, and washer 162; where the following correspond to washer 113: washer 152B and washer 163; where the following oorrespond to washer 114: washer 152, and washer 172; where the following correspond to washer 115: washer 153, and washer 173; and where the following correspond to nut 116: nut 154 and nut 174.

With attention being drawn to FIG. 10, and by comparing FIG. 10 to FIG. 8, it is seen that the pivot assemblies 37, 38, and 39 allow for dual adjustments through the use of axes at right angles to one another. The components used in connection with the adjustments depicted in FIG. 10 include bolt as at 77, washer as at 120, washer as at 121, cylinder or sleeve as at 76, washer as at 122, washer as at 123, washer as at 124, and nut as at 125. Washers 120 and 124 are ideally comprised of steel or aluminum, while washers 121, 122, and 123 are ideally comprised of material such as nylon, thermoplastic or thermoset materials for the reasons detailed above. Cylinder or sleeve 76 may be comprised of molded nylon, thermoplastic or thermoset materials or any other durable material. While pivot assembly 39 has been chosen for discussion, it will be understood that identical components are employed in connection with pivot assemblies 37 and 38. In connection with this, attention is drawn back to FIG. 6 where the following corresponds to washer 120: washer 140 and washer 130; where the following corresponds to washer 121: washer 140A, and washer 131; where the following corresponds to washer 122: washer 141, and washer 132; where the following corresponds to washer 123: washer 142, and washer 133; where the following corresponds to washer 124: washer 143, and washer 134; and where the following corresponds to nut 125: nut 144, and nut 135.

Axis 44 employs materials identical to axes 43, 41, and 37B. These materials include bolt 84 which passes through washers 160 and 161, and through bifurcated distal tip end 80 of arm segment 17 including ears 81 and 82, through washers 162, 163, 180 and 181 before being secured by nut 164.

Figure 4:
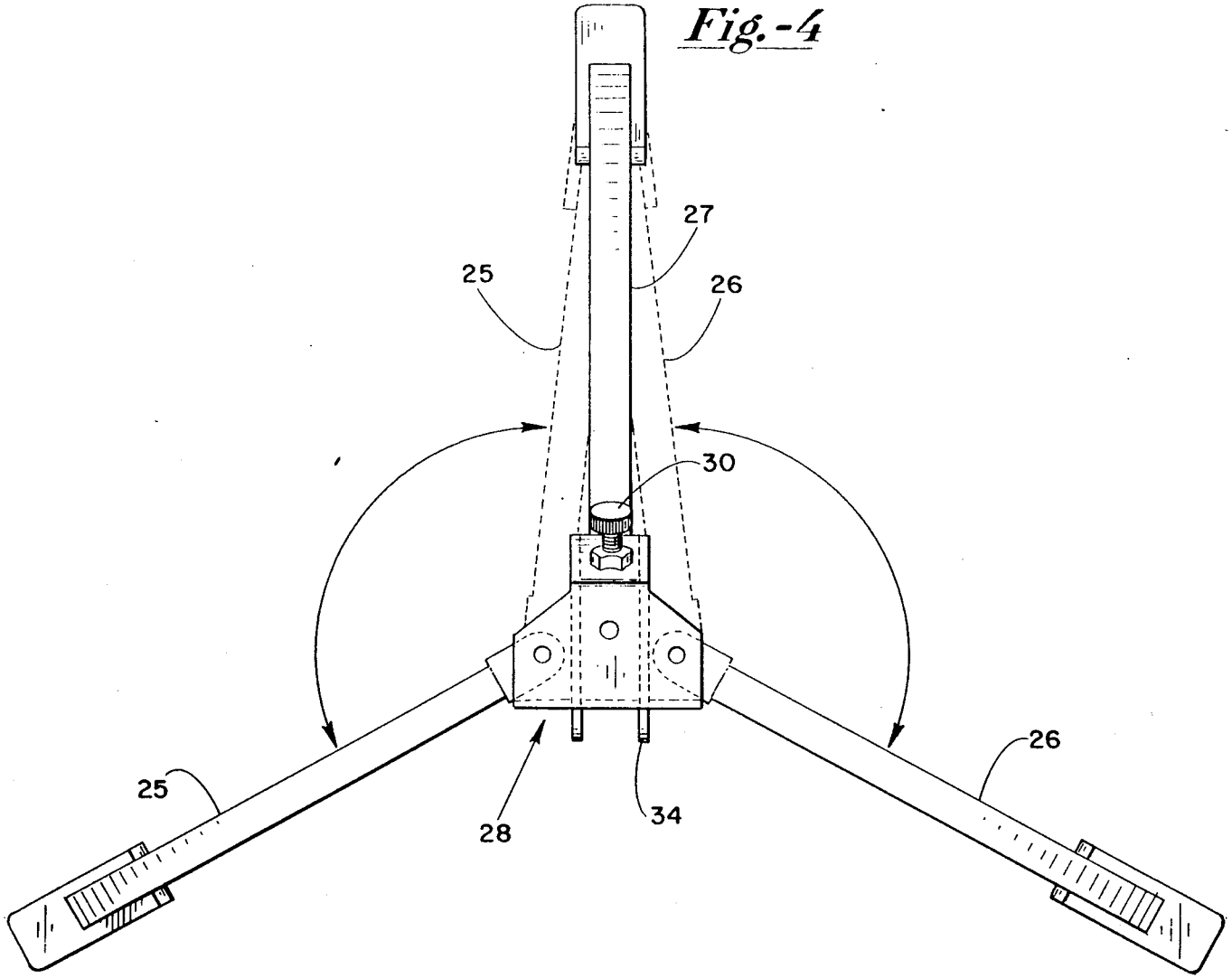
FIG. 4 is a top plan view illustrating the manner in which the support legs may be folded for ease of carrying, with the support disc member normally positioned along the top surface of the seat mount plate being removed for purposes of clarity.

With attention being drawn back to FIGS. 4 and 5, it is seen that the apparatus is capable of being folded down into a conveniently transportable package. Specifically, articulating support arm assembly 14 may be folded downwardly, with legs 25 and 26 being folded arcuately. Leg 27 may be folded about its horizontally disposed axis so as to meet and be arranged in close proximity to legs 25 and 26. By simply attaching a carrying strap through bore 33, the user may support the folded assembly in an over-the-shoulder disposition and transport the assembly to and from its place of use. If desired, and as depicted in FIG. 1, the arrangement may be covered with a cloth or material of camouflaged design so as to permit ease of use and operation in various game hunting activities. Other features may, of course, be employed as desired.

It will be appreciated by those skilled in the art that the present invention is also well suited to support and stabilize a variety of other motion sensitive devices including cameras, sensors, transmitters, and recording equipment. Hence, limitation to using the present invention strictly for supporting a firearm is not to be inferred.

It will be appreciated by those skilled in the art that various modifications may be made without actually departing from the spirit and scope of the present invention.

What is claimed is:

1. Firearm support and seat arrangement, comprising, in combination:

(a) support means including a tripod supported seat assembly;

(b) an articulating support arm assembly comprising a plurality of individual arm segments pivotally coupled together one to another to form said articulating support arm assembly, pivot assemblies arranged to pivotally interconnect individual arm segments to neighboring arm segments, and with each individual pivot assembly providing for relative motion, between adjacent arm segments about two axes of rotation, with said axes of rotation being disposed at right angles, one to the other;

(c) said pivot assemblies further including means for accommodating pivotal motion about axes arranged along vertically spaced apart horizontal planes, and at least one pivot assembly accommodating motion along a generally horizontal axis and with the other accommodating motion about a generally vertical axis; and (d) cradle means coupled to the distal end of said articulating support arm assembly for actively positionably retaining a firearm in cradled relationship therewithin.

2. The device described in claim 1 wherein said tripod supported seat assembly contains at least one leg which is pivotally secured about a generally vertically disposed axis, and wherein said tripod supported seat assembly contains at least one leg which is pivotally secured about a generally horizontally disposed axis.

3. The device described in claim 1 wherein said firearm support and seat arrangement is collapsible and contains a carrying strap.

4. The device described in claim 1 wherein the seat portion of said seat arrangement is rotatable about a generally vertical axis.

5. The device described in claim 2 wherein said firearm support and seat arrangement is collapsible and contains a carrying strap.

6. The device described in claim 2 wherein the seat portion of said seat arrangement is rotatable about a generally vertical axis.

7. The device described in claim 3 wherein the seat portion of said seat arrangement is rotatable about a generally vertical axis.

8. Support and seat arrangement, comprising, in combination:

(a) support means including a tripod supported seat assembly;

(b) an articulating support arm assembly comprising a plurality of individual arm segments pivotally coupled together one to another to form said articulating support arm assembly, pivot assemblies arranged to pivotally interconnect individual arm segments to neighboring arm segments, and with each individual pivot assembly providing for relative motion, between adjacent arm segments about two axes of rotation, with said axes of rotation being disposed at right angles, one to the other;

(c) said pivot assembles further including means for accommodating pivotal motion about axes arranged along vertically spaced apart horizontal planes, and at least one pivot assembly accommodating motion along a generally horizontal axis and with the other accommodating motion about a generally vertical axis; and (d) means coupled to the distal end of said articulating support arm assembly for actively positionably retaining an apparatus.

* * * * *